US010135204B2

(12) United States Patent
Zhang

(10) Patent No.: US 10,135,204 B2
(45) Date of Patent: Nov. 20, 2018

(54) ELECTRICAL CONNECTOR HAVING AN AUXILIARY CONTACT

(71) Applicant: FOXCONN INTERCONNECT TECHNOLOGY LIMITED, Grand Cayman (KY)

(72) Inventor: Jian-Li Zhang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/398,948

(22) Filed: Jan. 5, 2017

(65) Prior Publication Data

US 2017/0117673 A1 Apr. 27, 2017

Related U.S. Application Data

(63) Continuation-in-part of application No. 15/174,001, filed on Jun. 6, 2016, now Pat. No. 9,979,152.

(30) Foreign Application Priority Data

Jun. 5, 2015 (CN) ..... 2015 1 0301712
Jan. 5, 2016 (CN) ..... 2016 1 0001645

(51) Int. Cl.
*H01R 24/00* (2011.01)
*H01R 24/60* (2011.01)
(Continued)

(52) U.S. Cl.
CPC ..... *H01R 24/60* (2013.01); *H01R 13/405* (2013.01); *H01R 13/516* (2013.01);
(Continued)

(58) Field of Classification Search
CPC ..... H01R 13/405; H01R 13/648; H01R 13/6581; H01R 13/6587; H01R 23/7073; H01R 23/02
(Continued)

(56) References Cited

U.S. PATENT DOCUMENTS 6,056,569 A * 5/2000 Nakamura ..... H01R 13/506 439/189
7,540,782 B2 * 6/2009 Takahashi ..... G06K 7/0021 439/630
(Continued)

FOREIGN PATENT DOCUMENTS

CN 201904481 7/2011
CN 102856684 1/2013
(Continued)

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An electrical connector includes: an insulative housing having a base and a tongue; an upper and lower rows of contacts mounted in the insulative housing and exposed to an upper and lower surfaces of the tongue, the upper row of contacts and the lower row of contacts being equal in number; and an auxiliary contact disposed among the upper row of contacts. The upper rows of contacts and the lower row of contacts and a metallic shielding sheet are integrally formed within an insulator via a one shot initial insert-molding process to form an initial module. Some of the contacts are equipped with ears viewable upon the corresponding surface of the tongue.

20 Claims, 16 Drawing Sheets

(51) Int. Cl.

| | |
|---|---|
| ***H01R 13/516*** | (2006.01) |
| ***H01R 13/6585*** | (2011.01) |
| ***H01R 13/405*** | (2006.01) |
| ***H01R 13/6581*** | (2011.01) |
| ***H01R 13/6593*** | (2011.01) |
| ***H01R 43/16*** | (2006.01) |
| ***H01R 43/24*** | (2006.01) |
| *H01R 107/00* | (2006.01) |
| *H01R 12/50* | (2011.01) |
| *H01R 13/648* | (2006.01) |
| *H01R 13/6587* | (2011.01) |

(52) U.S. Cl.
CPC ..... *H01R 13/6581* (2013.01); *H01R 13/6585* (2013.01); *H01R 13/6593* (2013.01); *H01R 43/16* (2013.01); *H01R 43/24* (2013.01); *H01R 13/648* (2013.01); *H01R 13/6587* (2013.01); *H01R 23/02* (2013.01); *H01R 23/7073* (2013.01); *H01R 2107/00* (2013.01)

(58) Field of Classification Search
USPC ... 439/736, 660, 676, 607.01, 607.4, 607.55
See application file for complete search history.

(56) References Cited

U.S. PATENT DOCUMENTS

| | | | | |
|---|---|---|---|---|
| 8,206,168 | B2 * | 6/2012 | Niitsu ..... | H01R 13/2442 439/260 |
| 8,864,526 | B2 | 10/2014 | Kim et al. | |
| 2010/0248517 | A1 | 9/2010 | Hon Hai | |
| 2013/0178110 | A1 | 7/2013 | Xie et al. | |
| 2014/0065889 | A1 | 3/2014 | Zhang et al. | |
| 2014/0206209 | A1 | 7/2014 | Kamei et al. | |
| 2015/0044886 | A1 | 2/2015 | Little | |
| 2015/0207257 | A1 | 7/2015 | Dai et al. | |
| 2016/0020568 | A1 * | 1/2016 | Ju ..... | H01R 24/78 439/607.01 |
| 2016/0020572 | A1 | 1/2016 | Ju et al. | |
| 2016/0294130 | A1 | 10/2016 | Guo | |
| 2016/0359274 | A1 | 12/2016 | Zhang et al. | |

FOREIGN PATENT DOCUMENTS

| | | | |
|---|---|---|---|
| CN | 103296510 | | 9/2013 |
| CN | 203631831 | | 6/2014 |
| CN | 203859265 | | 10/2014 |
| CN | 203859265 | U * | 10/2014 |
| CN | 203859275 | | 10/2014 |
| CN | 203859329 | | 10/2014 |
| CN | 203932381 | | 11/2014 |
| CN | 203942066 | | 11/2014 |
| CN | 204067706 | | 12/2014 |
| CN | 204179333 | | 2/2015 |
| CN | 104466592 | | 3/2015 |
| CN | 204243301 | U | 4/2015 |
| CN | 204289872 | | 4/2015 |
| CN | 204315752 | | 5/2015 |
| CN | 204333335 | | 5/2015 |
| CN | 105098433 | | 11/2015 |
| CN | 105140696 | | 12/2015 |
| CN | 105206963 | | 12/2015 |
| JP | 3195845 | U | 2/2018 |
| TW | M409560 | | 8/2011 |
| TW | M454014 | | 5/2013 |
| TW | M466370 | | 11/2013 |
| TW | M501018 | | 5/2015 |
| TW | M508136 | | 5/2015 |

* cited by examiner

| A1 | A2 | A3 | A4 | A5 | A6 | A7 | A8 | A9 | A10 | A11 | A12 |
|---|---|---|---|---|---|---|---|---|---|---|---|
| | | | | CC1 | D+ | D− | SBU1 | Vbus | | | GND |
| GND | | | Vbus | | D− | D+ | CC2 | | | | |
| B12 | B11 | B10 | B9 | B8 | B7 | B6 | B5 | B4 | B3 | B2 | B1 |

FIG. 12

ELECTRICAL CONNECTOR HAVING AN AUXILIARY CONTACT

CROSS-REFERENCE TO RELATED APPLICATIONS

This patent application relates to a U.S. patent application Ser. No. 15/088,159, filed on Apr. 1, 2016, entitled "ELECTRICAL CONNECTOR WITH IMPROVED TERMINALS ARRAY," a U.S. patent application Ser. No. 15/174,001, filed on Jun. 6, 2016, entitled "ELECTRICAL CONNECTOR HAVING IMPROVED CONTACT MODULE AND METHOD FOR MAKING SAME," on which the priority is claimed, and a U.S. patent application Ser. No. 15/348,928, filed on Nov. 10, 2016, entitled "ELECTRICAL CONNECTOR HAVING IMPROVED CONTACT MODULE AND METHOD FOR MAKING SAME," which are all assigned to the same assignee as this application.

BACKGROUND OF THE INVENTION

1. Field of the Invention

The present invention relates to a flippable electrical connector having an auxiliary contact.

2. Description of Related Arts

China Patent No. 204179333, published on Feb. 25, 2015, discloses a flippable electrical connector having seven (7) upper contacts out of twelve (12) upper contact positions and seven (7) lower contacts out of twelve (12) lower contact positions. China Patent No. 204315752, published on May 6, 2015, shows a flippable electrical connector having five (5) upper contacts out of twelve (12) upper contact positions and five (5) lower contacts out of twelve (12) lower contact positions.

U.S. Patent Application Publication No. 2014/0065889, published on Mar. 6, 2014, discloses an insulative body defining a plurality contact receiving grooves, a plurality of contacts disposed in the contact receiving grooves, and a plurality of bridge portions positioned between adjacent contacts. The insulative body includes a plurality of openings to expose the bridge portions, which assists in cutting and removal of the bridge portions through the openings.

U.S. Patent Application Publication No. 2016/0020572, published on Jan. 21, 2016. discloses an electrical connector molding method including a step of connecting a front end of a respective first terminal to a primary carrier strip and a back end of the respective first terminal to a secondary carrier strip and a step of connecting a front end of a respective second terminal to another primary carrier strip and a back end of the respective second terminal to another secondary carrier strip.

SUMMARY OF THE INVENTION

An electrical connector comprises: an insulative housing having a base and a tongue; an upper and lower rows of contacts mounted in the insulative housing and exposed to an upper and lower surfaces of the tongue, the upper row of contacts and the lower row of contacts being equal in number; and an auxiliary contact disposed among the upper row of contacts. The upper rows of contacts and the lower row of contacts and a metallic shielding sheet are integrally formed within an insulator via a one shot initial insert-molding process to form an initial module. Some of the contacts are equipped with ears viewable upon the corresponding surface of the tongue.

BRIEF DESCRIPTION OF THE DRAWING

FIG. 12 schematically shows a diagram of contact positions of the electrical connector of FIG. 1;

DETAILED DESCRIPTION OF THE PREFERRED EMBODIMENT

Figure 1:
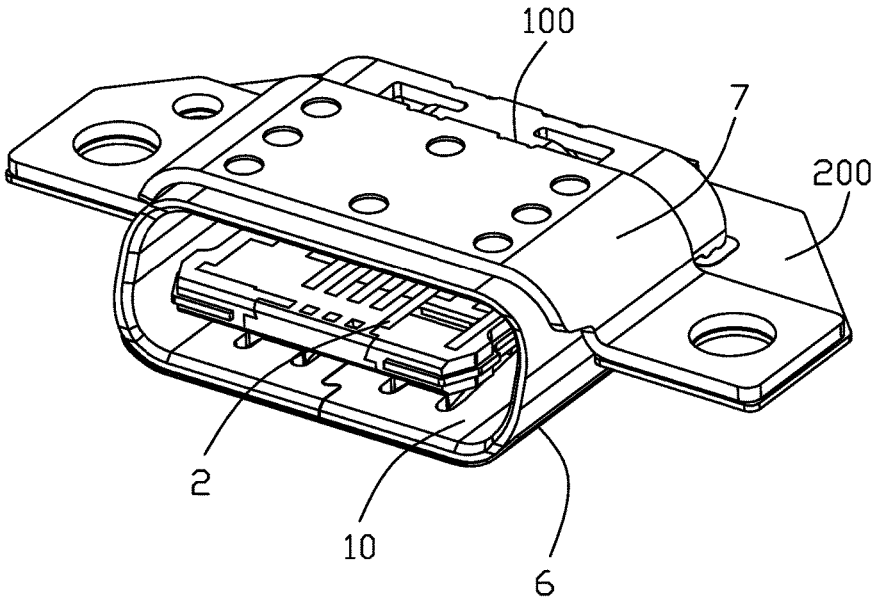
FIG. 1 is a perspective view of an electrical connector in accordance with the present invention.
Figure 2:
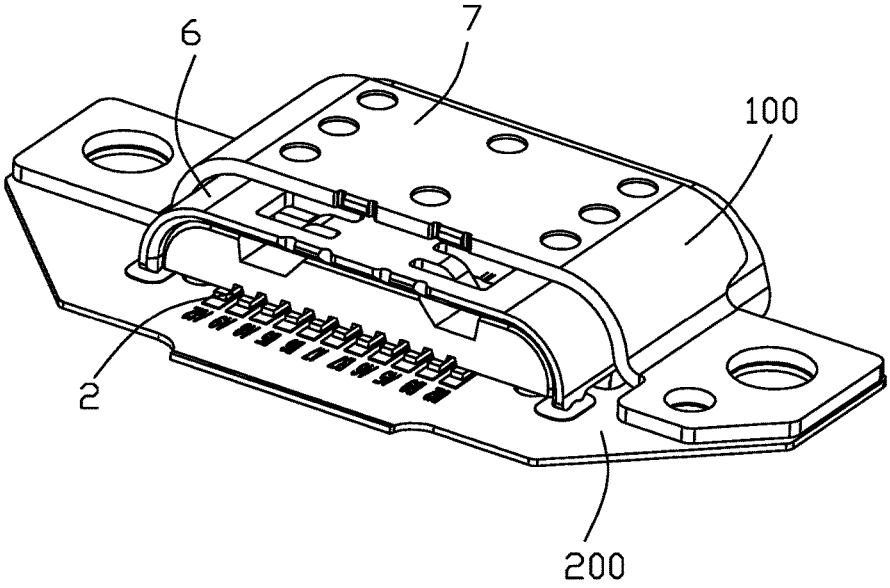
FIG. 2 is another perspective view of the electrical connector of FIG. 1.
Figure 3:
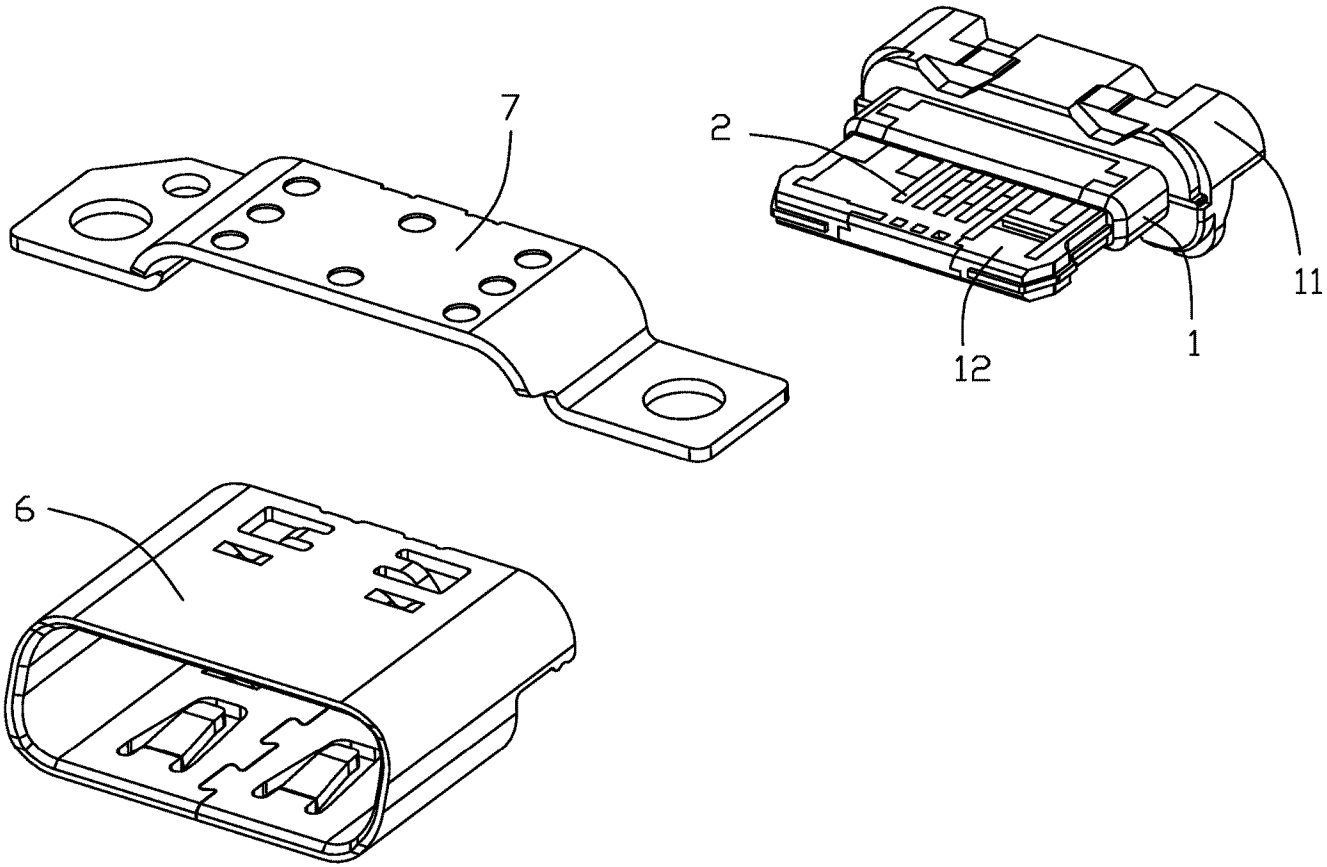
FIG. 3 is an exploded view of the electrical connector of FIG. 1.

Referring to FIGS. 1 to 8, an electrical connector 100 to be mounted on a printed circuit board 200 generally comprises an insulative housing 1, a plurality of contacts 2 including an upper/first and lower/second (rows of) contacts 21 and 22 mounted in the insulative housing 1, and an auxiliary contact 21*b* disposed among the upper row of contacts 21. The electrical connector 100 further comprises a middle metallic shielding sheet 5 mounted in the insulative housing 1 between the upper and lower rows of contacts 21 and 22, an inner shell 6 enclosing the insulative housing 1, and an outer shell 7 enclosing the inner shell 6.

The insulative housing 1 has a base 11 and a tongue 12.

Figure 9:
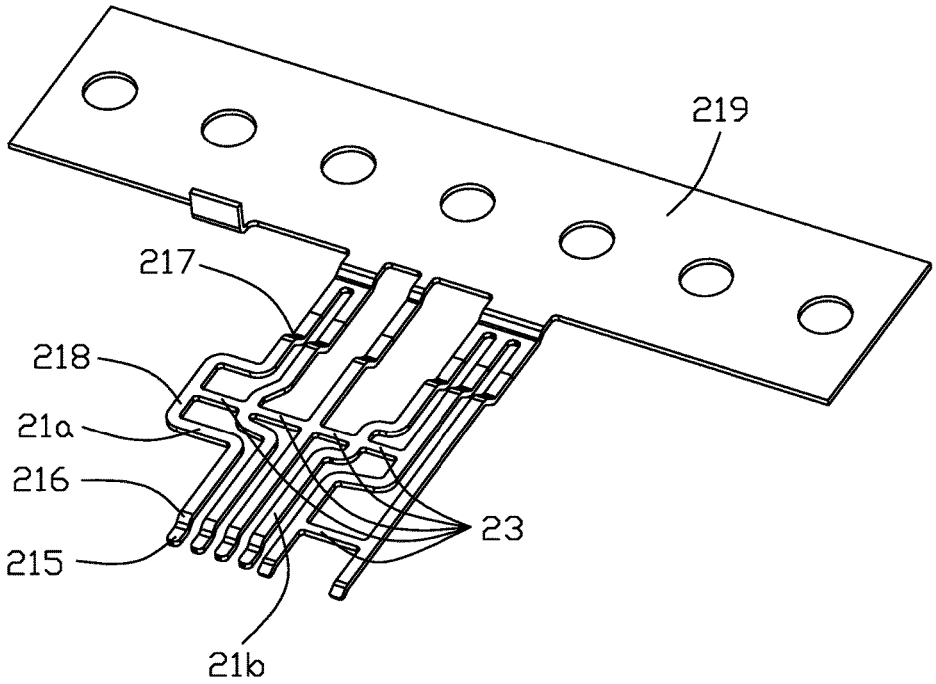
FIG. 9 shows an upper row of contacts of the electrical connector of FIG. 1.

Also referring to FIG. 9, each contact 21*a* of the upper row of contacts 21 and the auxiliary contact 21*b* each have a front head 215, a neck 216, a tail 217, and a connection portion 218 between the neck 216 and the tail 217. Cutoff bridges 23 interconnect the connection portions 218 before cutting.

Figure 10:
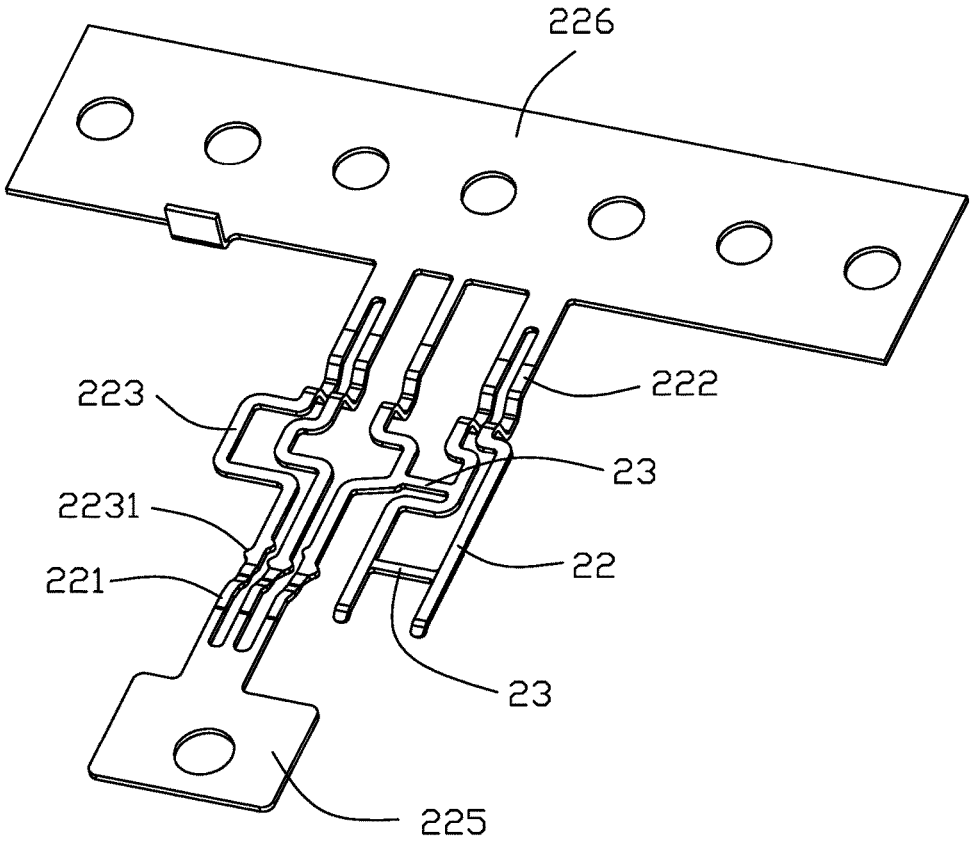
FIG. 10 shows a lower row of contacts of the electrical connector of FIG. 1.

Also referring to FIG. 10, each of the lower row of contacts 22 has a respective front end, a tail 222, and a connection portion 223 between the front end and the tail 222. The connection portion 223 may have one or more ears 2231. The front ends of three of the five contacts 22 shown, including the middle one, have a respective extended portion 221 connected to a secondary carrier strip. The connection portions 223 of the middle contact 22 and the other two contacts 22 are shown interconnected by cutoff bridges 23.

Figure 8:
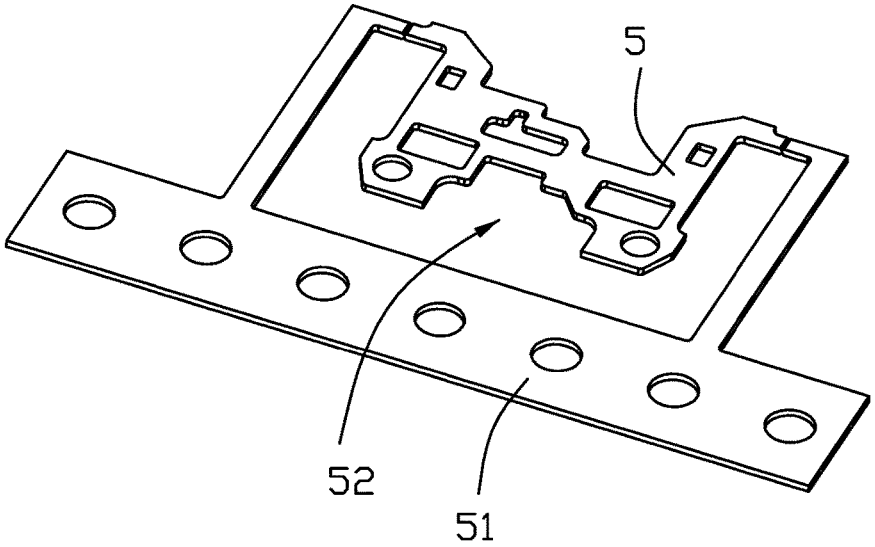
FIG. 8 shows a middle shielding sheet of the electrical connector of FIG. 1.

As shown in FIGS. 8-10, the contacts 21*a* and the auxiliary contact 21*b* in the upper row are formed on and from a same carrier strip 219, the lower contacts 22 are formed on and from opposite front carrier strip 225 and rear carrier strip 226, and the middle shielding sheet 5 is formed on and from a further carrier strip 51.

Figure 6:
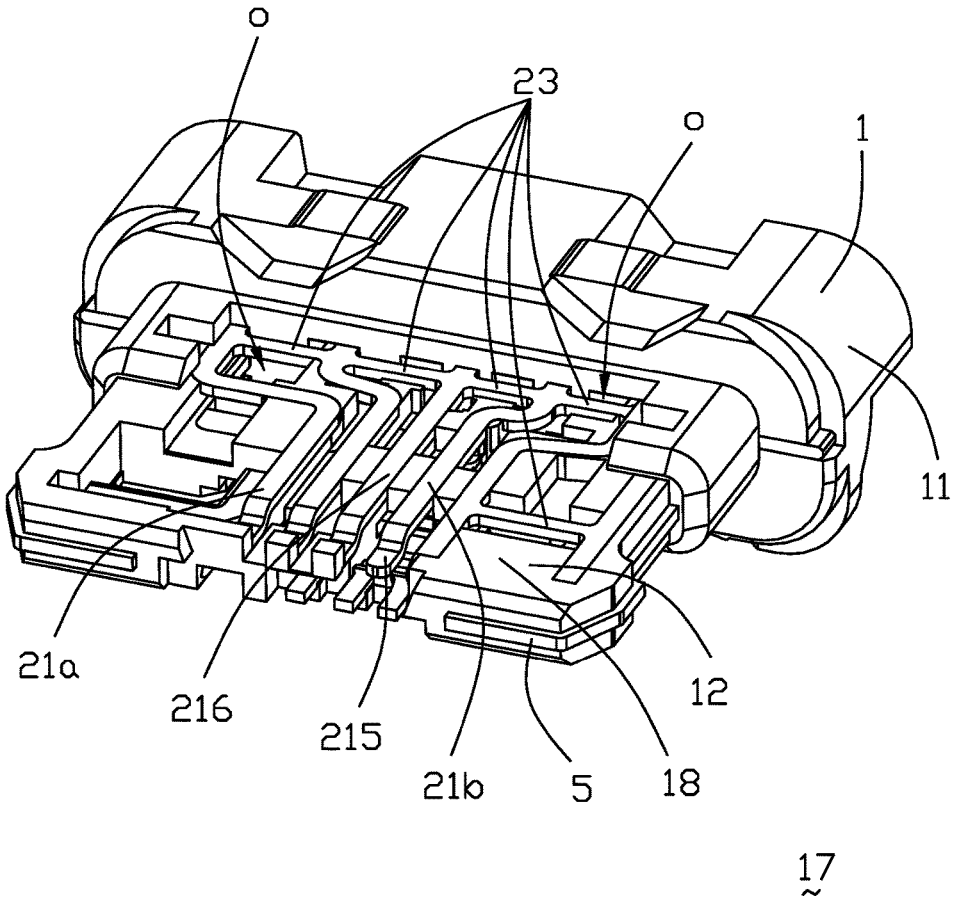
FIG. 6 is a view similar to FIG. 4 before forming a final insert-molding.
Figure 7:
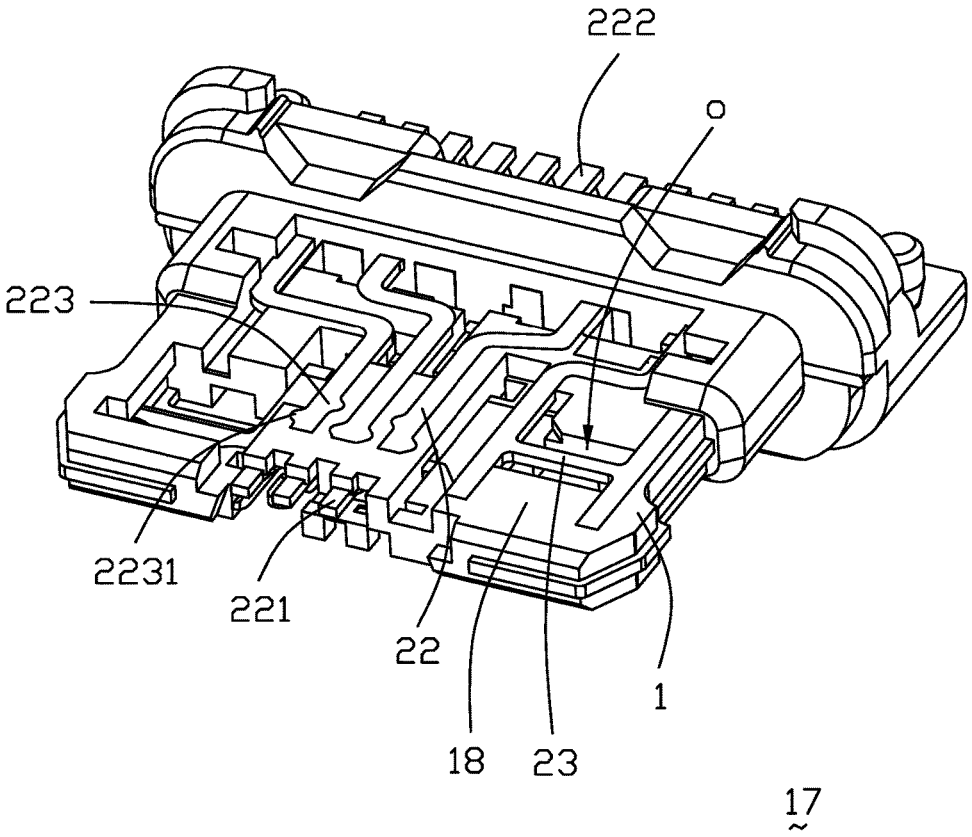
FIG. 7 is a view similar to FIG. 6 but from a different perspective.
Figure 11:
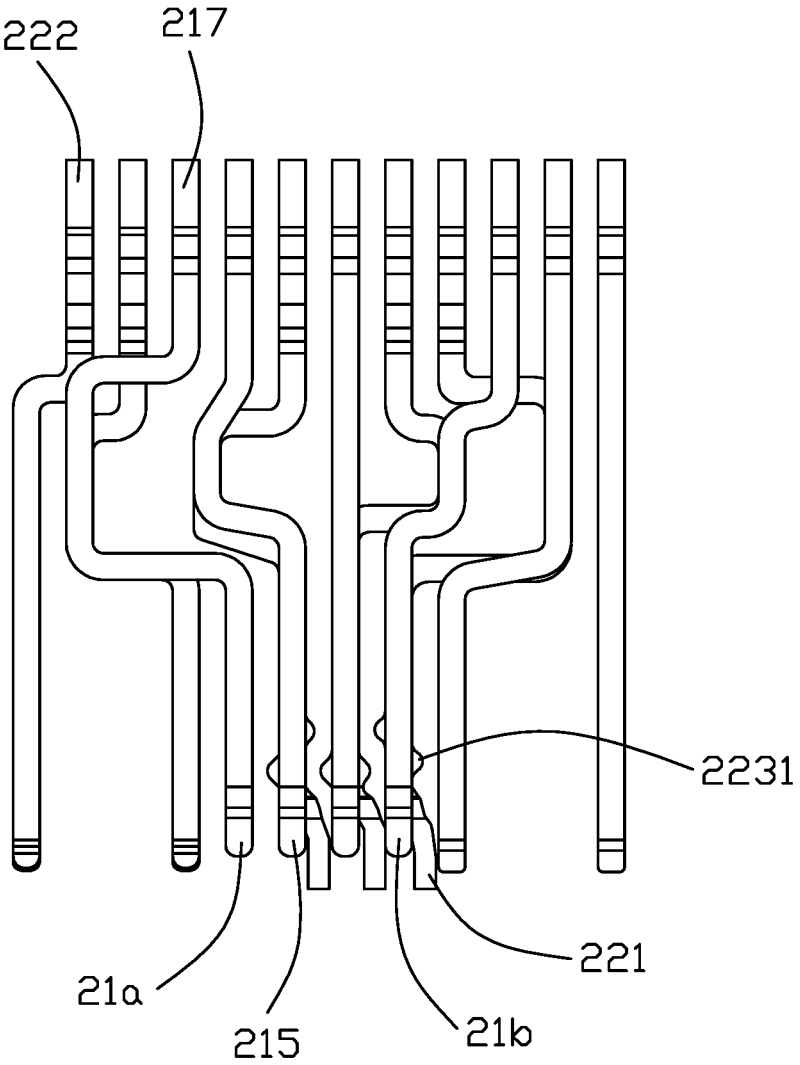
FIG. 11 is a top view of the upper and lower rows of contacts.
Figure 13:
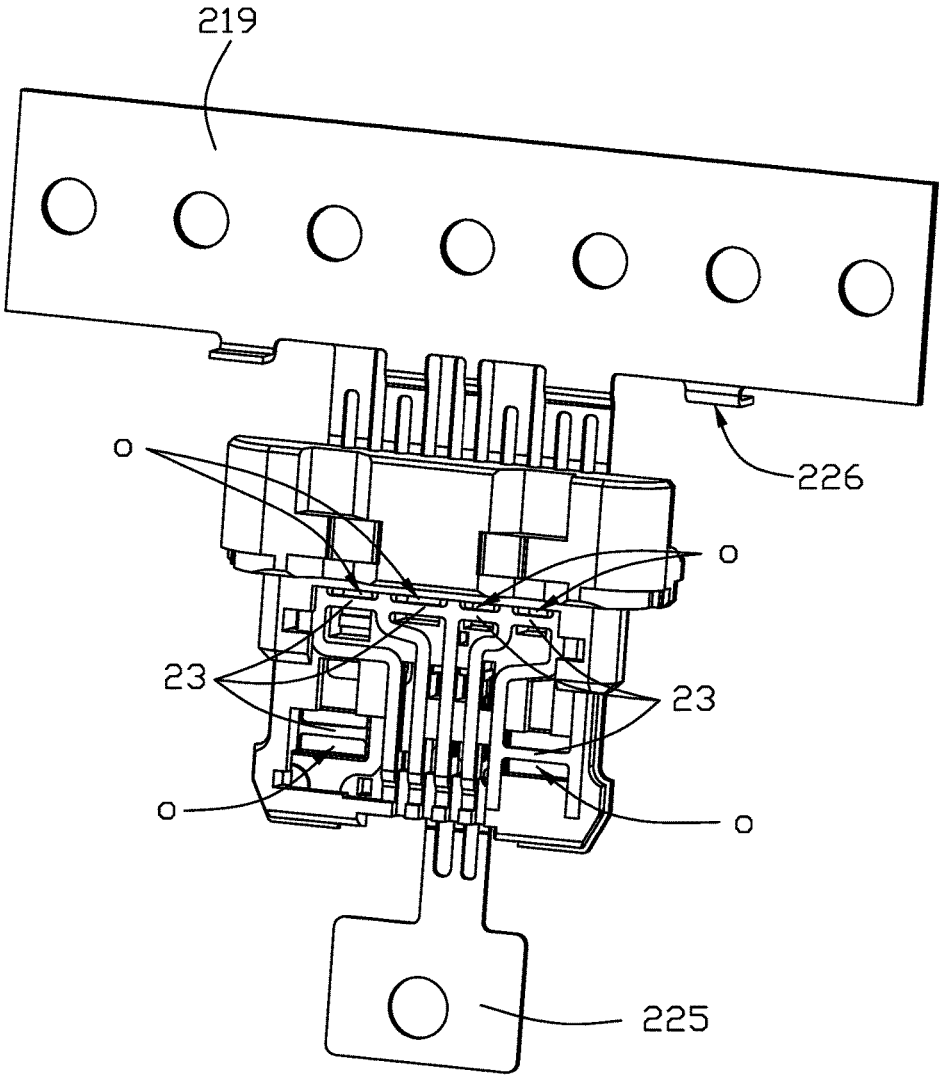
FIG. 13 is a downward perspective view of the initial module of the electrical connector of FIG. 1 after the initial/first insert molding operation while before the final/second insert molding operation wherein the carrier strips are still attached upon the corresponding upper and lower rows of contacts.
Figure 14:
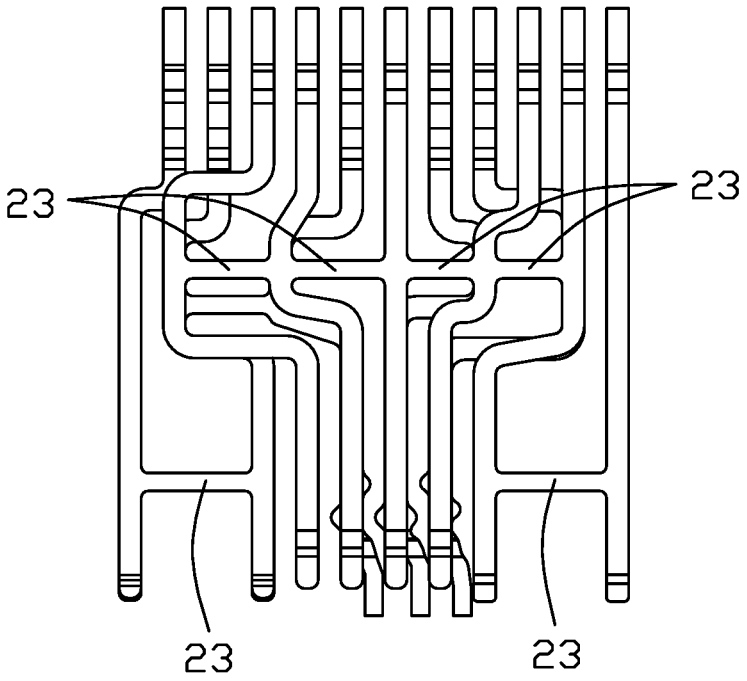
FIG. 14 is a top view of the upper and lower rows of contacts of the electrical connector of FIG. 1, similar to FIG. 11 while without removing the associated cutoff bridges therefrom.

The extended portions 221 and the front heads 215, as shown in FIGS. 6 and 7, provide pressing/holding area during insert molding operation. Also referring to FIG. 11, the extended portions 221 are offset sidewardly to clear from the front heads 215 for being pressed by molds for subsequent removal of carrier strips and cutoff bridges. The ears 2231 are also seen protruding sidewardly. Therefore, all contacts 21*a*, 21*b*, 22 and the sheet 5 are insert molded together within an insulator 18 via an initial insert-molding operation to commonly be an initial module 17 as shown in FIGS. 6 and 7 wherein the base 11 is essentially complete while the tongue 12 is incomplete.

Figure 4:
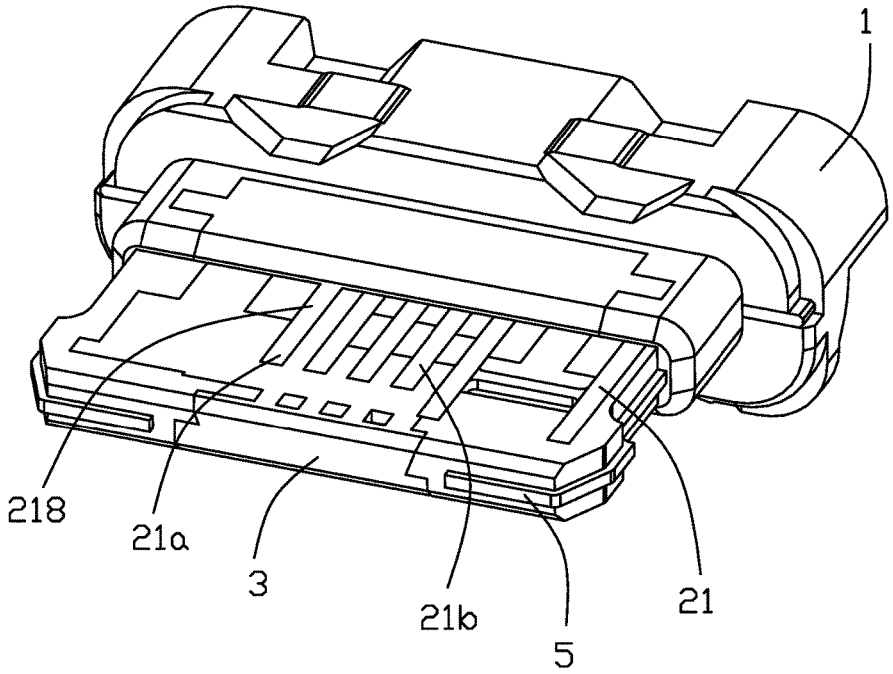
FIG. 4 is a further perspective view of the electrical connector of FIG. 1, omitting an inner and outer shells thereof.
Figure 5:
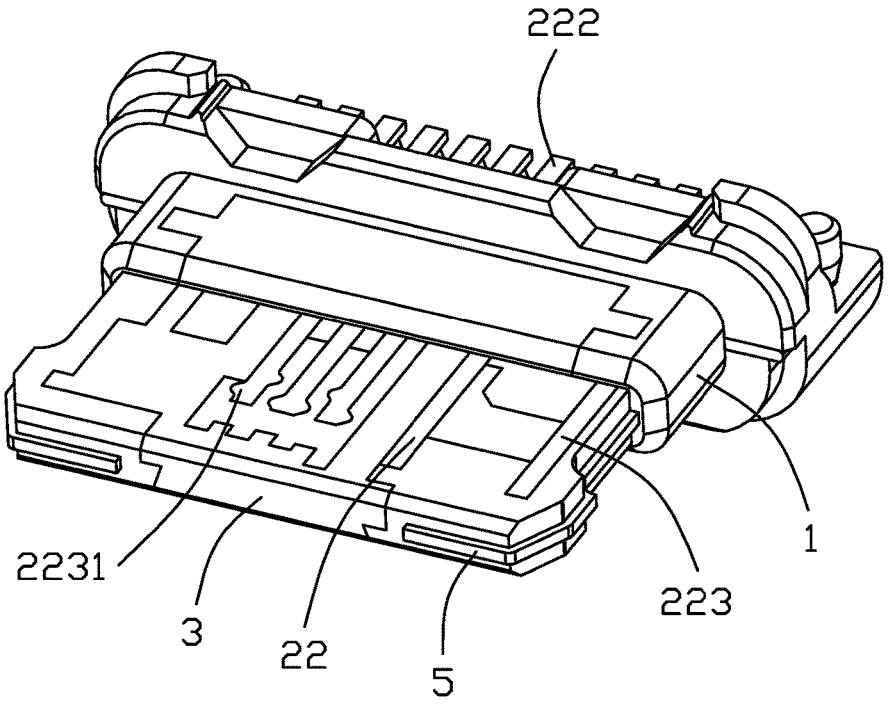
FIG. 5 is a view similar to FIG. 4 but from a different perspective.

As shown in FIGS. 4 and 5, an insulative block 3 is further applied upon the tongue portion of the initial module 17 to finalize the tongue 12 during a final insert/over molding operation while exposing respective front parts of the connection portions 218 and 223 to exterior from an upper and lower surfaces of the tongue 12.

The inner shell 6 encloses the insulative housing 1 to define an insertion space 10 for receiving a mating connector.

Arrangement of the upper contacts 21 (excluding contact 21*b*) and the lower contacts 22 on the tongue 15 is generally symmetrical in the sense that orientation of the constructed electrical connector can be flipped. As shown in FIG. 12, twelve (12) contact positions, A1 through A12 from left to right, are defined on the upper surface of the tongue 12 and twelve (12) contact positions, B1 through B12 from right to left, are defined on the lower surface of the tongue 12. The five contacts 21*a* in the upper row occupy positions A5, A6, A7, A9, and A12 while the five contacts 22 in the lower row occupy positions B5, B6, B7, B9, and B12. The auxiliary contact 21*b* is disposed at an eighth position A8 out of the twelve contact positions on the tongue and can be used for transmitting required signals as needed.

The electrical connector of the present invention has a total of eleven (11) contacts, which meets USB 2.0 specification, large current applications, and is flippable and intermateable with Type C plugs.

One important feature of the invention is regarding the cooperation among the cutoff bridges 23, the ears 2231, the carrier strip 225, 226, 219 for use within the insert-molding process/operation. It should be noted that similar to the aforementioned related pending applications, the subject electrical connector is made via a first/initial insert-molding process to have all the upper row of contacts 21, the lower row of contacts 22, and the shielding sheet 5 commonly integrally formed within an insulator 18 to form an initial module 17 via a single initial insert-molding process. Notably, even though the insert-molding process is an old art, it is really difficult to have three parts at the three different levels, i.e., the upper contacts 21, the lower contacts 22 and the sheet 5 therebetween, insert-molded within an insulator 18 via a one shot molding process. It is because each part is required to be held by pin type devices of the mold to retain its position in both the vertical direction and the horizontal direction. Understandably, the carrier strip 219 of the upper rows of contacts 21 and the carrier strips 225, 226 of the lower row of contacts 22 are used to maintain the true positions of the corresponding contacts 21, 22 in the front-to-back direction.

Anyhow, even though the front and/or rear ends are fixed by the carrier strip, under the high pressure of the insert-molding process, the middle regions of the contacts may be deflected in either the vertical direction or the transverse direction. This is the reason why the cutoff bridges 23 are used to maintain the neighboring contacts 21, 22 with the fixed distance for controlling the transverse true positions of the corresponding contacts 21, 22. Understandably, those cutoff bridges 23 are required to be removed from the corresponding contacts 21, 22. Therefore, it is required to have the sufficient openings/spaces to allow a puncher to move into the corresponding openings/spaces in the vertical direction to remove the cutoff bridges 23.

However, it is required to have the enough space or relatively large opening for puncher operation. In the instant invention, the upper row of contacts 21 includes five contacts 21 with four cutoff bridges 23 linked between the rear spanning large area of every adjacent two contacts 21, thus having no problem. In this embodiment, the openings O are formed in the initial module 17 and aligned with the corresponding bridges 23 for allowing the puncher (not shown) to be inserted thereinto in the vertical direction for breaking the cutoff bridges 23 from the corresponding contacts 21, 22, referring to FIGS. 6-7, 9-10 and 13-14.

Differently, on one hand for the lower row of contacts 22 because the rear spanning large area of three neighboring contacts 22 are overlapped with that of those of the upper row of contacts 21 in the vertical direction, it is not allowed to use the cutoff bridges 23 for the lower row of contacts 22 in that area; otherwise, there will be an interference during the puncher operation for removing the bridges 23 of the upper row of contacts 21 and the bridges of the lower row of contacts 22. On the other hand, it is somewhat improper to apply the bridges 23 on the front region of the contacts 22. It is because the pitch between every adjacent contacts 22 is too small, thus somewhat precluding efficient movement of the puncher. This is the reason why in the instant invention, an additional/front carrier strip 225 is used to link the front ends of the three contacts 22 for maintaining true positions of those lower row of contacts 22, compared with the upper row of contacts 21 having only the rear carrier strip 219.

Figure 15:
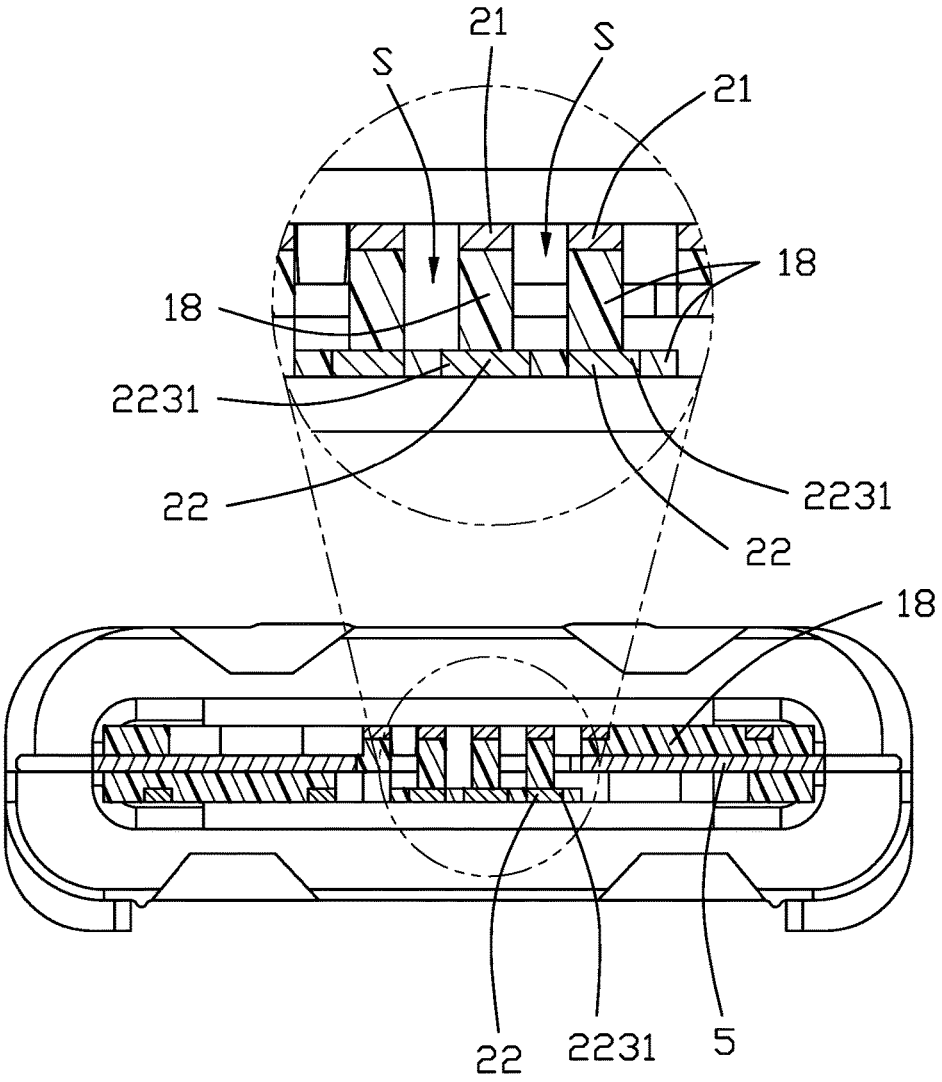
FIG. 15 is a cross-sectional view of the initial module of the electrical connector of FIG. 1.
Figure 16:
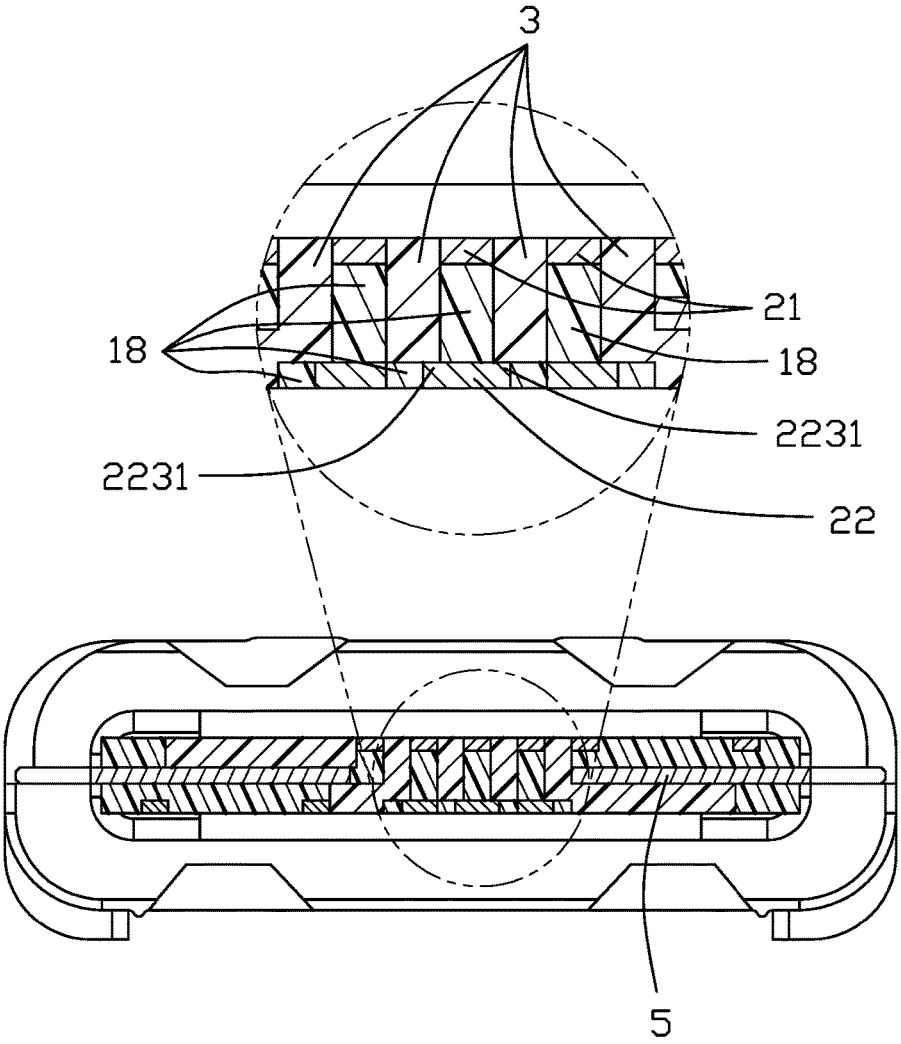
FIG. 16 is a cross-sectional view of the electrical connector of FIG. 1 after the insulative block is applied upon the initial module to form the complete tongue/housing.

It is also noted that because of lacking the bridges 23, the lower row of contacts 22 use the sideward protruding ears 2231 to be pressed by the corresponding pin type piece of the mold (not shown) for holding in position during the initial insert-molding process so as to have such ears 2231 exposed in the corresponding space S in the insulator 18 of the initial module 17 after the initial insert-molding process, referring to FIG. 15. Notably, such a space S will be filled by the material of the insulative block 3 after the second/final insert-molding process in which the complete tongue 12 is formed. Referring to FIGS. 8 and 15-16, the shielding sheet 5 includes a recess 52 not to isolate the upper contacts 21 and the lower contacts 22 in the vertical direction so that the corresponding upper contact 21 and lower contact 22 which are aligned with each other in the vertical direction may be supported by the insulator 18 after the initial insert-molding process. It is also noted that in the initial module 17 on one hand, the space S may extend through the insulator 18 in the vertical direction, and under such a situation the ear 2231 is pressed (by the mold) not only in the vertical direction but also in the transverse direction during the initial insert-molding process. On the other hand, the cutoff bridges 23 are also pressed by the mold in both the vertical direction and the transverse direction during the initial insert-molding process.

In addition, it is noted that because the three lower row of contacts 22 are linked by the front carrier strip 225, the front end regions of those three lower row of contacts 22 are intentionally not only offset along the transverse direction from those of the corresponding upper row of contacts 21 but also extending forwardly beyond the corresponding upper row of contacts 21 in the front-to-back direction, for easy manufacturing without interference.

In brief, the instant invention follows the spirit of the related parent application, i.e., having three parts (the upper contacts, the lower contacts and the shielding sheet) integrally formed together with an insulator as an initial module via one shot insert-molding process, via cooperation among the carrier strips 51, 219, 225, 226, the bridges 23, the space S, the openings O, and the ears 2231 wherein the instant invention requires more endeavored arrangement because the invention now has eleven contacts compared with only ten contacts in the parent application. Notably, in this embodiment, the tongue 12 forms opposite upper/first and lower/second surfaces (not labeled) in the vertical direction and each upper contact 21 has an upper contacting section (not labeled) exposed upon the upper surface (not labeled) and each lower contact 22 has a lower contacting section (not labeled) exposed upon the lower surface (not labeled) wherein the ears 2231 of the lower contacts 22 are viewable upon the lower surface (not labeled) of the tongue 12 from an exterior. Understandably, the ears 2231 of the lower contacts 22 may be formed upon the upper contacts 21 instead.

What is claimed is:

1. An electrical connector comprising:

an insulative housing defining a base and a tongue, said tongue defining opposite first and second surfaces in a vertical direction;

a plurality of first contacts spaced from one another in one row along a transverse direction perpendicular to the vertical direction, each of said first contacts extending along a front-to-back direction perpendicular to both said vertical direction and said transverse direction, each of said first contacts including a contacting section exposed upon the first surface;

a plurality of second contacts spaced from one another in another row along the transverse direction, each of said second contacts extending along the front-to-back direction, each of said second contacts including a contacting section exposed upon the second surface;

a metallic shielding sheet located between the first contacts and the second contacts in said vertical direction; and all said first contacts, said second contacts and said shielding sheet being integrally formed within an insulator to form an initial module via a single shot insert-molding process, said insulator being part of the insulative housing; wherein said contacting sections of at least some of the first contacts have sideward protruding ears exposed and viewable upon the first surface.

2. The electrical connector as claimed in claim 1, wherein the initial module forms some inside spaces in which the ears are exposed in the vertical direction for being pressed during the single shot insert-molding process.

3. The electrical connector as claimed in claim 2, further including an insulative block applied upon the insulator of the initial module via a final insert-molding process to complete said tongue.

4. The electrical connector as claimed in claim 3, wherein said space is filled by material of said insulative block during said final insert-molding process.

5. The electrical connector as claimed in claim 1, wherein the contacting sections of said first contacts are aligned with the contacting sections of the corresponding second contacts in the vertical direction, and the shielding sheet forms a recess not to isolate said contacting sections of the first contacts and said contacting sections of the second contacts in the vertical direction, and the insulator supports both said contacting sections of the first contacts and those of the second contacts in the vertical direction after the initial insert-molding process.

6. The electrical connector as claimed in claim 5, wherein in each paired first contact and second contact which are aligned with each other in the vertical direction, a front end of one is offset from the other in the transverse direction.

7. The electrical connector as claimed in claim 5, wherein in each paired first contact and second contact which are aligned with each other in the vertical direction, a front end of one extends beyond the other in the front-to-back direction.

8. The electrical connector as claimed in claim 7, wherein said front end is connected to a carrier strip during the initial insert-molding process.

9. The electrical connector as claimed in claim 1, wherein either said first contacts or said second contacts include some bridges linked between neighboring either two first contacts or two second contacts, and the insulator forms a plurality of openings to expose said bridges in the vertical direction for removal of said bridges after the initial insert-molding process via punching.

10. An electrical connector comprising:

an insulative housing defining a base and a tongue, said tongue defining opposite first and second surfaces in a vertical direction;

a plurality of first contacts spaced from one another in one row along a transverse direction perpendicular to the vertical direction, each of said first contacts extending along a front-to-back direction perpendicular to both said vertical direction and said transverse direction, each of said first contacts including a contacting section exposed upon the first surface;

a plurality of second contacts spaced from one another in another row along the transverse direction, each of said second contacts extending along the front-to-back direction, each of said second contacts including a contacting section exposed upon the second surface;

a metallic shielding sheet located between the first contacts and the second contacts in said vertical direction; and all said first contacts, said second contacts and said shielding sheet being integrally formed within an insulator to form an initial module via a single shot insert-molding process, said insulator being part of the insulative housing; wherein the first contacts have bridges holding the contacting sections in position during the single shot insert-molding process and located in an opening of the insulator, while said bridges are removed through said opening after the single shot insert-molding process but before an insulative block is applied upon the insulator to fill the opening by another insert-molding process; and some of the second contacts have bridges linked sidewardly for retaining the second contacts in position during the single shot insert-molding process and located in another opening of the insulator, the contacting sections of the first contacts and the contacting sections of the second contacts are aligned with each other in the vertical direction while the bridges of the first contacts are offset from the bridges of the second contacts in the vertical direction for not only holding the contacting sections of both the first contacts and the second contacts in position during the single shot insert-molding but also removing said bridges after the single shot insert-molding process via said respective openings.

11. The electrical connector as claimed in claim 10, wherein the contacting sections of some of the second contacts have extended portions at front ends thereof, respectively, for connecting to a front carrier which is removed after the single shot insert-molding process and before the another insert-molding process.

12. The electrical connector as claimed in claim 11, wherein the extended portions are sidewardly offset from the corresponding contacting sections, respectively.

13. The electrical connector as claimed in claim 12, wherein said extended portions are exposed outside of the insulator after the single shot insert-molding process while is embedded within the insulative block after said another insert-molding process.

14. The electrical connector as claimed in claim 10, wherein the contacting sections of some of the second contacts have sideward protruding ears thereon and are equipped with a front carrier strip while the contacting sections of the first contacts have no sideward protruding ears thereon and are not equipped with any front carrier strip, and said front carrier strip is removed after the single shot insert-molding process and before said another insert-molding process.

15. The electrical connector as claimed in claim 10, wherein the shielding sheet forms a recess, and the insulator extends through the recess with two opposite ends to support the contacting sections of the first contacts and the contacting sections of the second contacts, respectively, in the vertical direction.

16. An electrical connector comprising:

an insulative housing defining a base and a tongue, said tongue defining opposite first and second surfaces in a vertical direction;

a plurality of first contacts spaced from one another in one row along a transverse direction perpendicular to the vertical direction, each of said first contacts extending along a front-to-back direction perpendicular to both said vertical direction and said transverse direction, each of said first contacts including a contacting section exposed upon the first surface;

a plurality of second contacts spaced from one another in another row along the transverse direction, each of said second contacts extending along the front-to-back direction, each of said second contacts including a contacting section exposed upon the second surface;

a metallic shielding sheet located between the first contacts and the second contacts in said vertical direction; and all said first contacts, said second contacts, and said shielding sheet being integrally formed within an insulator to form an initial module via a single shot insert-molding process, said insulator being part of the insulative housing; wherein the first contacts have bridges holding the first contacts in position during the single shot insert-molding process and located in an opening of the insulator, while said bridges are removed through said opening after the single shot insert-molding process but before an insulative block is applied upon the insulator to fill the opening by another insert-molding process; and the contacting sections of some of the second contacts have extended portions at front ends thereof, respectively, for connecting to a front carrier which is removed after the single shot insert-molding process and before the another insert-molding process.

17. The electrical connector as claimed in claim 16, wherein the extended portions are sidewardly offset from the corresponding contacting sections, respectively.

18. The electrical connector as claimed in claim 17, wherein said extended portions are exposed outside of the insulator after the single shot insert-molding process while is embedded within the insulative block after said another insert-molding process.

19. The electrical connector as claimed in claim 16, wherein the contacting sections of some of the second contacts have sideward protruding ears and are equipped with a front carrier strip while the contacting sections of the first contacts have no sideward protruding ears thereon and are not equipped with any front carrier strip, and said front carrier strip is removed after the single shot insert-molding process and before said another insert-molding process.

20. The electrical connector as claimed in claim 16, wherein the shielding sheet forms a recess, and the insulator extends through the recess with two opposite ends to support the contacting sections of the first contacts and the contacting sections of the second contacts, respectively, in the vertical direction.

* * * * *